US006202438B1

(12) United States Patent
Barito

(10) Patent No.: US 6,202,438 B1
(45) Date of Patent: Mar. 20, 2001

(54) COMPRESSOR ECONOMIZER CIRCUIT WITH CHECK VALVE

(75) Inventor: Thomas Barito, Arkadelphia, AR (US)

(73) Assignee: Scroll Technologies, Arkadelphia, AR (US)

( * ) Notice: Subject to any disclaimer, the term of this patent is extended or adjusted under 35 U.S.C. 154(b) by 0 days.

(21) Appl. No.: 09/447,481

(22) Filed: Nov. 23, 1999

(51) Int. Cl.[7] ..... F25B 41/00

(52) U.S. Cl. ..... 62/513; 62/197; 62/217; 62/505

(58) Field of Search ..... 62/513, 113, 505, 62/197, 217, 196.4

(56) References Cited

U.S. PATENT DOCUMENTS 4,899,555 * 2/1990 Shaw ..... 62/505
5,094,085 * 3/1992 Irino ..... 62/175
5,157,933 * 10/1992 Brendel ..... 62/196.4
5,167,130 * 12/1992 Morris ..... 62/196.1
5,197,297 * 3/1993 Bendel et al. ..... 62/81
5,582,022 * 12/1996 Heinrichs et al. ..... 62/175
5,598,718 * 2/1997 Freund et al. ..... 62/238.6
5,626,027 * 5/1997 Dormer et al. ..... 62/175
5,692,389 * 12/1997 Lord et al. ..... 62/222
5,724,821 * 3/1998 Lord et al. ..... 62/84
5,806,327 * 9/1998 Lord et al. ..... 62/115
5,829,265 * 11/1998 Lord et al. ..... 62/298
6,047,556 * 4/2000 Lifson ..... 62/196.2
6,138,467 * 10/2000 Lifson et al. ..... 62/217

* cited by examiner

*Primary Examiner*—Corrine McDermott
*Assistant Examiner*—Marc Norman
(74) *Attorney, Agent, or Firm*—Carlson, Gaskey & Olds

(57) ABSTRACT

An improved efficiency economizer system for compressors incorporates the use of a check valve blocking return flow into the economizer return line. The economizer return line communicates with an economizer port, which communicates with a compression chamber. Pressure in the compression chamber can vary during the operational cycle of the compressor. Thus, in the past, there has sometimes been backflow of refrigerant through the economizer injection port and into the return line. The present invention prevents this backflow. Most preferably, the invention is utilized on scroll compressors; however, other types of compressors may benefit from this invention.

13 Claims, 2 Drawing Sheets

COMPRESSOR ECONOMIZER CIRCUIT WITH CHECK VALVE

BACKGROUND OF THE INVENTION

This invention relates to the use of a check valve to prevent backflow of refrigerant into an economizer line in a compressor during portions of the operational cycle of the compressor.

As known, a typical refrigeration cycle includes a compressor, a condenser, an expansion valve and an evaporator. Refrigerant is compressed at the compressor and sent to the condenser, wherein it is cooled by an external environment. Refrigerant from the condenser then passes to the expansion valve, and from the expansion valve to the evaporator. In the evaporator, air from an environment to be cooled, is cooled by the refrigerant. The refrigerant then returns to the compressor. This basic refrigeration cycle has been improved upon by many efficiency features.

Modern refrigeration cycles are typically provided with many functional characteristics to improve the efficiency of the circuits.

One major improvement in the refrigeration cycle is the use of an economizer circuit. In an economizer circuit, the refrigerant is further treated between the condenser and the expansion valve. Basically, the refrigerant leaving the condenser is split into two flow paths. One of the two flow paths is passed through an expansion valve, and then into an economizer heat exchanger. The gas in the second flow path is further cooled by the first path refrigerant which has been expanded. Thus, the refrigerant passing through the second line is cooled to a point that is lower than it otherwise would have been when it approaches the main expansion valve.

Economizers are utilized to provide a high degree of cooling capacity. The refrigerant in the first path which has passed through the expansion valve and to the economizer heat exchanger must be returned to the compressor. Thus, compressors incorporating an economizer circuit typically have an economizer return path leading to an injection port in the compressor. A valve on the return path selectively opens and closes flow to provide or block use of the economizer cycle.

One type of compressor which is achieving wide acceptance in refrigerant compression applications is a scroll compressor. In a scroll compressor, a pair of scroll members each have a base and a generally spiral wrap extending from the base. The wraps interfit to define compression chambers. One of the two scroll members is driven to orbit relative to the other, and as this orbiting occurs, compression chambers defined between the interfitting wraps are reduced in volume to compress an entrapped refrigerant. As compression occurs, the pressure within the compression chambers cyclically increases and decreases.

When an economizer circuit is utilized in a scroll compressor, the economizer injection port typically extends through one of the scroll members and into one of the compression chambers. Often the economizer port extends through the non-orbiting scroll member. The economizer injection port will communicate with a chamber which is thus at a pressure which varies during the operational cycle of the scroll compressor. At times, the pressure in this chamber may be higher than the pressure in the economizer return path. At such times, there can be backflow of refrigerant through the economizer port, and out of the compression chambers.

This backflow results in efficiency and pumping loses, which are undesirable. These pumping losses can also occur during periods of time when the economizer circuit is closed since there typically is a relatively long distance between the economizer shutoff valve and the injection port.

These variations in operational pressures occur in other types of compressors, and are not limited to scroll compressors. Thus, while the invention will be described with reference to a scroll compressor, it should be understood that the invention described in this application can apply to other type compressors.

SUMMARY OF THE INVENTION

In a disclosed embodiment of this invention, an economizer injection port in a compressor is provided with a check valve. Fluid is allowed to move through the economizer return path and the economizer injection port and enter the compression chambers. However, backflow of the fluid is blocked by the check valve.

In a preferred embodiment of this invention, the compressor is a scroll compressor. The economizer injection port extends through the base of the non-orbiting scroll.

Preferably, a check valve chamber is formed in a connecting member which receives and communicates with the economizer injection port. The check valve may be a spring biased valve plate which is biased to a closed position, but driven to open when the pressure in the economizer return path exceeds the pressure in the compression chamber. Alternatively, the check valve may be magnetically driven, but opened when the pressure in the economizer return path exceeds the magnetic force. In a third embodiment, the check valve is a reed-type check valve which is biased to a closed position, but also selectively opened.

These and other features of the present invention can be best understood from the following specification and drawings, the following of which is a brief description.

DETAILED DESCRIPTION OF A PREFERRED EMBODIMENT

Figure 1:
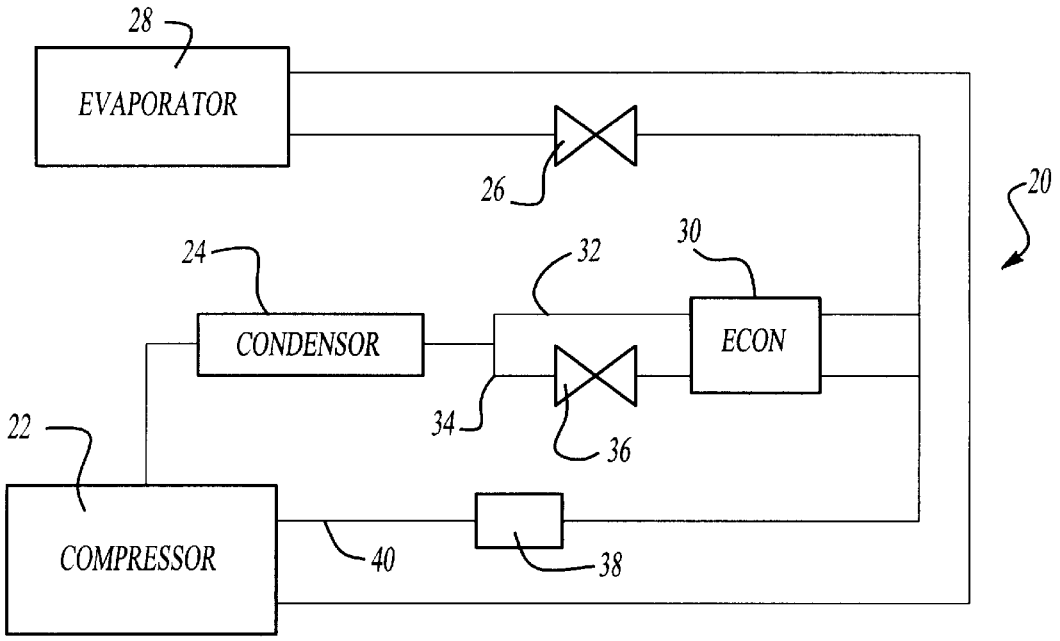
FIG. 1 shows a refrigerant cycle.

A refrigeration cycle 20 includes a compressor 22 communicating with a condenser 24. Refrigerant from the condenser 24 typically passes to an expansion valve 26 which in turn communicates with an evaporator 28. Refrigerant from the evaporator 28 is returned to the suction line of the compressor 22. The standard cycle described to this point is the well known refrigerant cycle which has been utilized for years.

An economizer circuit and heat exchanger 30 are sometimes incorporated into such a system between the condenser 24 and the expansion valve 26. An economizer circuit has two flow paths 32 and 34 branching from the line communicating the condenser 24 to the expansion valve 26. Fluid in the line 34 passes through an expansion valve 36 such that it is cooled prior to entering the heat exchanger 30. Gas in the other line 32 is cooled by the refrigerant in the line 34. Thus, the refrigerant from line 32 leaving the economizer heat exchanger 30 and passing to the expansion valve 26 is cooler than it otherwise would have been. Refrigerant from the line 34 is returned to the compressor through an economizer valve 38 which can be selectively opened and closed to provide or prevent operation of the economizer circuit. A return line 40 passes from valve 38 back into the compressor 22.

Figure 2:
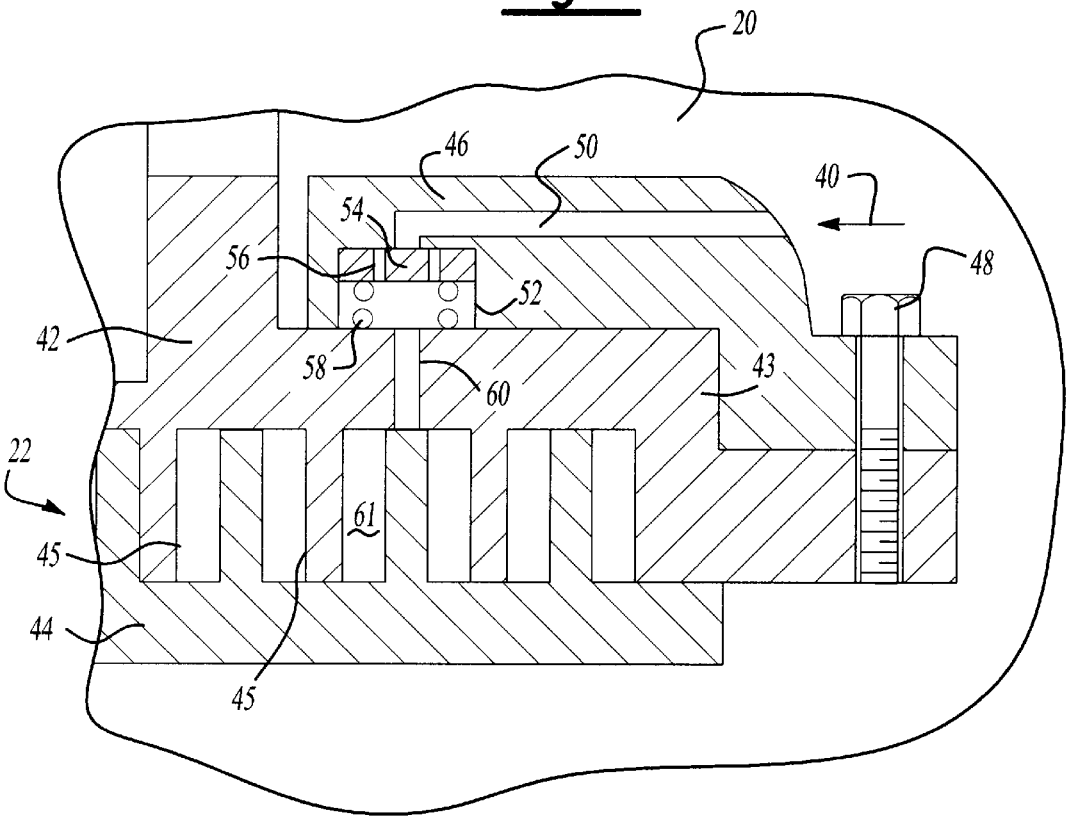
FIG. 2 shows a first embodiment of the present invention.

FIG. 2 shows an embodiment of the compressor 22 wherein the compressor is a scroll compressor having a non-orbiting scroll 42 with a base 43 facing an orbiting scroll 44. Both scroll members 42 and 44 have spiral wraps 45 which interfit.

An economizer return connection 46 is attached by a pin 48 to the base 43.

A return line 50 communicates with line 40, and passes into a valve chamber 52. A plate valve 54 having a plurality of ports 56 is biased by spring 58 to a closed position. In this position, gas cannot flow from the line 50 into the chamber 52, through the ports 56, and into the injection port 60.

The injection port 60 communicates with a compression chamber 61. As is known in this art, during the orbital cycle of the orbiting scroll 44 the pressure in chamber 61 varies. Thus, at certain times the pressure in chamber 61 may exceed the pressure in the return line 50. At such times, the valve 54 is driven to the closed position such as illustrated in FIG. 2. At this position, the gas cannot flow back into the return line 50 from the chamber 61. Thus, the pumping losses which are experienced in the prior art are minimized.

On the other hand, when the pressure in chamber 61 is relatively low, the gas can pass through the return line 50 and into the chamber 61.

Figure 3:
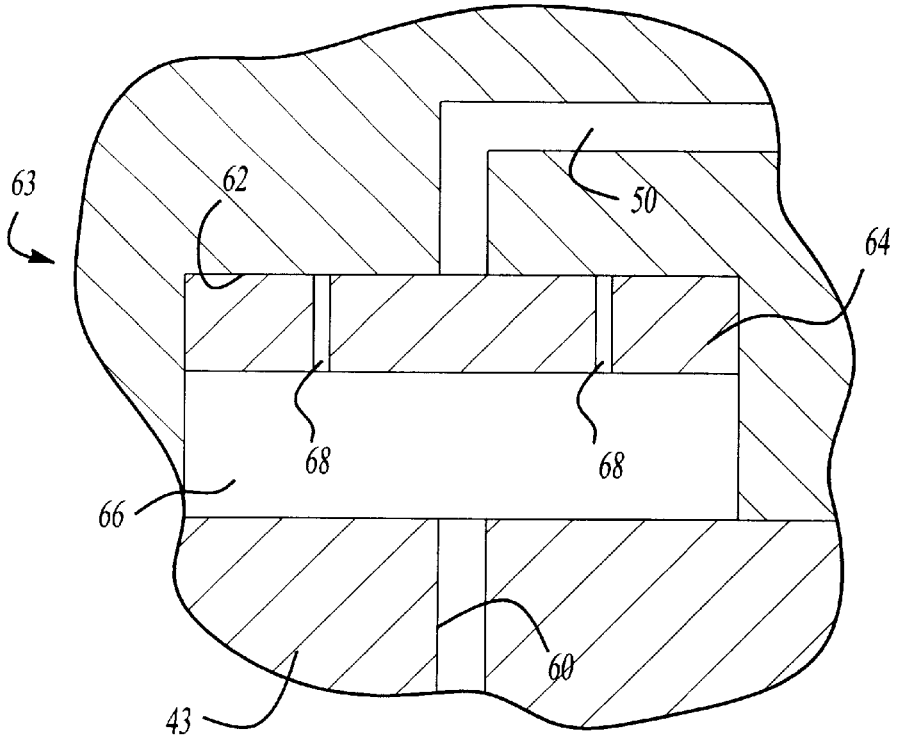
FIG. 3 shows a second embodiment of the present invention.

FIG. 3 shows yet another embodiment 63 of the valve for the present invention. In this embodiment, a surface 62 at the top of the valve chamber 66 is formed of a ferrous material. The valve 64 is magnetized such that it is typically held against the surface 62. In this position ports 68 which extend through the plate 64 are blocked. Fluid cannot flow into the chamber 66. This invention thus provides a second means of preventing backflow into the line 50 when the pressure in the chamber 61 is higher than the pressure on line 50. When the pressure on line 50 is higher than the pressure in chamber 61, the refrigerant overcomes the magnetic force and drives the valve 64 downwardly such that refrigerant may pass from line 50 into the injection port 60.

Figure 4:
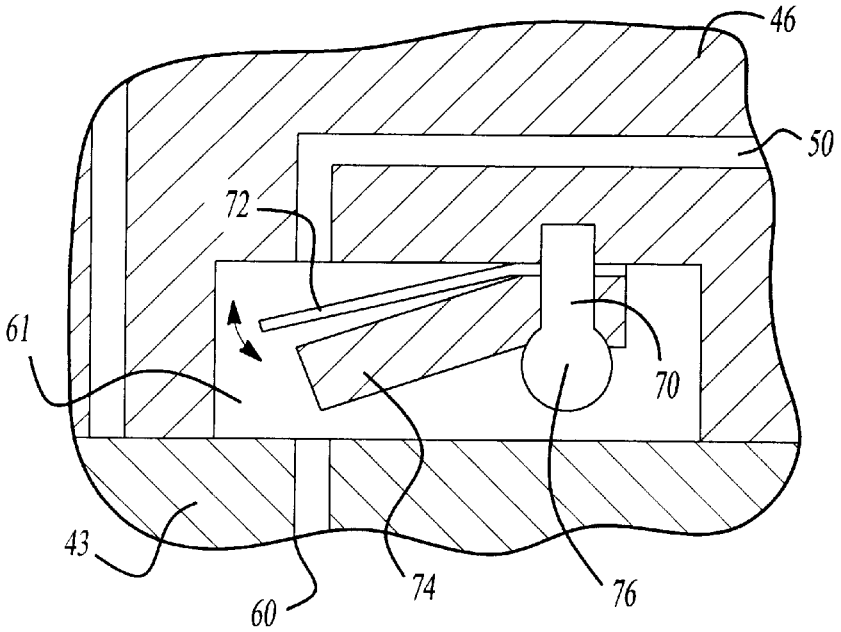
FIG. 4 shows a third embodiment of the present invention.

FIG. 4 shows yet another embodiment wherein the valve assembly 71 includes a reed valve 72 which is normally biased to a position such that it closes the return line 50. In the illustrated position, pressure on the return line 50 has driven the reed valve 72 to an open position where it abuts a valve stop 74. A pin 76 secures the valve 72 and stop 74 to connection member 46. This invention operates similar to the prior embodiments in that when the pressure in the chamber 61 is lower than the pressure in line 50 the valve may open; however, when the pressure in chamber 61 is higher, the valve 72 closes the return line 50 blocking return flow.

While the check valves are shown rearward of the non-orbiting scroll 42, it should be understood that could also be incorporated into the non-orbiting scroll base.

In summary, the present invention improves upon the efficiency of systems incorporating an economizer circuit. In this way, the overall efficiency of the refrigerant cycle is improved. Although preferred embodiments of this invention have been disclosed, a worker in this art would recognize that certain modifications would come within the scope of this invention. For that reason, the following claims should be studied to determine the true scope and content of this invention.

What is claimed is:

1. A compressor comprising:

a compressor pump unit having at least compression chamber;

an economizer injection port for selectively communicating a refrigerant from an economizer return line into said compression chamber; and a check valve for allowing flow from said economizer return line and into said injection port, but blocking flow from said injection port into said economizer return line.

2. A compressor as recited in claim 1, wherein said compressor pump unit is a scroll compressor.

3. A compressor as recited in claim 2, wherein said injection port is formed in a base of a non-orbiting scroll.

4. A compressor as recited in claim 3, wherein said check valve is mounted in a cavity defined outwardly of said base of said non-orbiting scroll relative to an orbiting scroll.

5. A compressor as recited in claim 2, wherein said check valve is a plate having a plurality of ports extending through said plate, and a spring biasing said plate to a position blocking flow into said economizer return line.

6. A compressor as recited in claim 2, wherein said check valve is magnetized and is held against a ferrous surface to block return flow.

7. A compressor as recited in claim 2, wherein said check valve is a reed check valve having a stop member.

8. A scroll compressor comprising:

a first scroll member having a base and a generally spiral wrap extending from said base;

a second scroll member having a base and a generally spiral wrap extending from said base, said spiral wraps of said first and second scroll members interfitting to define compression chambers, and said second scroll member being driven to orbit relative to said first scroll member;

an economizer injection port extending through said base of said non-orbiting scroll;

an economizer return connection being connected to said economizer port, said economizer return connection including a passage adapted to communicate with an economizer return line; and a check valve selectively closing said economizer return line such that refrigerant can pass from said economizer return line and into said economizer injection port, but refrigerant cannot pass from said economizer injection port into said economizer return line.

9. A scroll compressor as recited in claim 8, wherein said check valve is mounted in said economizer return connection.

10. A compressor as recited in claim 8, wherein said check valve is a plate having a plurality of ports extending through said plate, and a spring biasing said plate to a position blocking flow into said economizer return line.

11. A compressor as recited in claim 8, wherein said check valve is magnetized and is held against a ferrous surface to block return flow.

12. A compressor as recited in claim 8, wherein said check valve is a reed check valve having a stop member.

13. A refrigeration cycle comprising:

a compressor;

a condenser downstream of said compressor; an economizer heat exchanger downstream from said condenser, flow from said condenser towards an economizer heat exchanger being split into two passages, with a first of said passages being provided with a first expansion member;

said first passage being returned to said compressor and a second of said two passages passing from said economizer heat exchanger to a second expansion device;

an evaporator downstream of said second expansion device, refrigerant from said evaporator being returned to said compressor; and said compressor being provided with an economizer injection port communicating with said economizer return line, and a check valve preventing flow into said economizer return line from said compressor, but allowing flow from said economizer return line into said compressor.

* * * * *